US008839965B2

(12) United States Patent
Benneche et al.

(10) Patent No.: US 8,839,965 B2
(45) Date of Patent: Sep. 23, 2014

(54) ADJUSTABLE, INSERTABLE SEMI-FLEXIBLE SHELF WITHIN A COMPARTMENT

(71) Applicants: John Christian Benneche, Long Beach, CA (US); Kelly Boehm Brown, Long Beach, CA (US)

(72) Inventors: John Christian Benneche, Long Beach, CA (US); Kelly Boehm Brown, Long Beach, CA (US)

( * ) Notice: Subject to any disclaimer, the term of this patent is extended or adjusted under 35 U.S.C. 154(b) by 44 days.

(21) Appl. No.: 13/872,703

(22) Filed: Apr. 29, 2013

(65) Prior Publication Data

US 2013/0233817 A1 Sep. 12, 2013

Related U.S. Application Data

(63) Continuation-in-part of application No. 12/683,381, filed on Jan. 6, 2010, now abandoned.

(51) Int. Cl.
*A47F 5/00* (2006.01)
*A47F 5/08* (2006.01)

(Continued)

(52) U.S. Cl.
CPC ..... *A47B 96/02* (2013.01); *A47B 96/04* (2013.01); *A47B 47/0075* (2013.01); *A47B 43/003* (2013.01); *A47B 46/005* (2013.01); *B65D 25/08* (2013.01); *A47F 5/10* (2013.01); *A47B 96/021* (2013.01); *F25D 3/08* (2013.01); *F25D 25/02* (2013.01); *F25D 2325/021* (2013.01); *F25D 2325/023* (2013.01); *F25D 2400/16* (2013.01)
USPC ..... 211/90.01; 211/86.01; 211/134; 211/149

(58) Field of Classification Search
CPC ..... A47B 43/02; A47B 96/04; A47B 43/003; A47B 47/0075; A47B 61/00; A47B 61/04; A47B 46/00; A47B 47/0058; A47B 47/0091; A47B 45/00; A47B 96/02; A47B 97/00; A47B 47/06; A47B 61/06; A47B 46/005; A47B 81/00; A47B 96/027; A47B 96/028; A47B 96/024; A47B 96/025; A47B 43/00; A47B 47/0025; A47B 96/06; A47B 96/021; B65D 81/3816; B65D 25/06; B65D 21/0233; B65D 21/0222; B65D 25/108; B65D 5/5038; B65D 7/065; B65D 25/022; B65D 25/02; B65D 25/04; B65D 25/08; B65D 25/10; F25D 3/08; F25D 3/06; F25D 25/02; F25D 23/069; F25D 3/045; F25D 23/067; F25D 2325/021; F25D 2325/023; F25D 2400/16; A45C 11/20; A45C 13/02; A45C 15/00; A45C 5/03; A45C 13/03; A47J 47/10; B25H 3/023; B25H 3/026; A47F 5/0043; A47F 5/0081; A47F 5/0087; A47F 5/08; A47F 5/10
USPC ..... 211/195, 189, 134, 135, 184, 85.2, 211/85.3, 90.01–90.04, 150, 41.5, 41.6, 211/153, 149, 43; 108/60; 312/3–6, 351, 312/408, 348.3; 220/9.4, 501, 505, 528, 220/529, 530, 531
See application file for complete search history.

(56) References Cited

U.S. PATENT DOCUMENTS 2,244,887 A 6/1941 Manley
2,564,478 A * 8/1951 Harbison ..... 211/153

(Continued)

*Primary Examiner* — Jennifer E Novosad
(74) *Attorney, Agent, or Firm* — Kirk A. Buttler; Buhler & Associates

(57) ABSTRACT

An insertable, semi-flexible shelf apparatus suspended and attached in a horizontal relationship within a compartment and anchored to anchor elements bonded to the inside wall surface of a portable cooler or drop-in horizontal freezer or portable storage bin container for better visibility, access, organization, and protection of food and food containers; fishing bait; and other items to retain and protect these items from damage due to wetness, frost and combination with other items.

13 Claims, 10 Drawing Sheets

(51) Int. Cl.

| | |
|---|---|
| ***A47B 96/02*** | (2006.01) |
| ***A47B 96/04*** | (2006.01) |
| ***A47B 43/00*** | (2006.01) |
| ***B65D 25/08*** | (2006.01) |
| ***A47F 5/10*** | (2006.01) |
| ***F25D 25/02*** | (2006.01) |
| *A47B 47/00* | (2006.01) |
| *A47B 46/00* | (2006.01) |
| *F25D 3/08* | (2006.01) |

(56) References Cited

U.S. PATENT DOCUMENTS

| | | | | | |
|---|---|---|---|---|---|
| 3,083,836 | A | | 4/1963 | Bussermer | |
| 3,201,022 | A | | 8/1965 | Galassco et al. | |
| 3,385,450 | A | * | 5/1968 | Nadler et al. | 211/42 |
| 3,385,452 | A | * | 5/1968 | Dantino et al. | 211/175 |
| 3,404,783 | A | * | 10/1968 | Whitman et al. | 211/88.01 |
| 3,612,288 | A | * | 10/1971 | Lesley | 211/132.1 |
| 3,688,914 | A | * | 9/1972 | Taber et al. | 211/59.4 |
| 4,138,175 | A | | 2/1979 | Tattershall | |
| 4,307,581 | A | | 12/1981 | Reid | |
| 4,424,687 | A | | 1/1984 | Morgan | |
| 4,515,421 | A | | 5/1985 | Steffes | |
| 4,551,988 | A | | 11/1985 | Petrantoni | |
| 4,565,074 | A | | 1/1986 | Morgan | |
| 4,848,772 | A | | 7/1989 | Lewis et al. | |
| 4,852,194 | A | | 8/1989 | Langan | |
| 4,916,923 | A | | 4/1990 | Adams | |
| 5,011,013 | A | | 4/1991 | Meisner | |
| 5,052,184 | A | | 10/1991 | Jarvis | |
| 5,052,185 | A | | 10/1991 | Spahr | |
| 5,123,564 | A | | 6/1992 | Hobson | |
| 5,213,221 | A | * | 5/1993 | Raye, Sr. | 211/195 |
| 5,314,080 | A | * | 5/1994 | Wentworth | 211/181.1 |
| 5,344,029 | A | * | 9/1994 | Oghia et al. | 211/41.8 |
| 5,437,165 | A | | 8/1995 | White et al. | |
| 5,524,761 | A | | 6/1996 | Wayman | |
| 5,601,198 | A | | 2/1997 | Reed | |
| 5,605,056 | A | | 2/1997 | Brown et al. | |
| 5,671,611 | A | | 9/1997 | Quigley | |
| 5,685,438 | A | | 11/1997 | Emanuel et al. | |
| 5,688,034 | A | * | 11/1997 | Kojima | 312/408 |
| 5,816,433 | A | | 10/1998 | Higgins | |
| 5,845,515 | A | | 12/1998 | Nelson | |
| 5,931,019 | A | | 8/1999 | White et al. | |
| 5,983,808 | A | * | 11/1999 | Weil | 108/152 |
| 6,050,663 | A | | 4/2000 | Schoellmann | |
| 6,105,654 | A | | 8/2000 | Martel | |
| 6,349,559 | B1 | | 2/2002 | Hasanovic | |
| 6,497,331 | B1 | * | 12/2002 | Morandi | 211/153 |
| 6,732,659 | B2 | | 5/2004 | Poon | |
| 6,782,711 | B2 | | 8/2004 | Abfalter | |
| 6,874,650 | B2 | | 4/2005 | Welsh et al. | |
| 6,899,237 | B2 | * | 5/2005 | Trent | 211/189 |
| 6,966,450 | B2 | | 11/2005 | Askew | |
| D536,405 | S | | 2/2007 | Freeman | |
| 7,270,245 | B2 | * | 9/2007 | Cheng et al. | 220/62.1 |
| 7,445,128 | B2 | * | 11/2008 | Kaczmarek | 211/41.8 |
| D601,654 | S | | 10/2009 | Sykes | |
| 7,665,475 | B2 | * | 2/2010 | Hedstrom et al. | 134/134 |
| 7,954,639 | B2 | | 6/2011 | Carney et al. | |
| 8,033,405 | B2 | | 10/2011 | Wang | |
| 8,087,108 | B2 | * | 1/2012 | Burns et al. | 4/657 |
| 2001/0040141 | A1 | * | 11/2001 | Martorella et al. | 211/41.6 |
| 2002/0084233 | A1 | * | 7/2002 | Martorella et al. | 211/41.6 |
| 2003/0111434 | A1 | | 6/2003 | Stoddart | |
| 2005/0045569 | A1 | * | 3/2005 | Chang | 211/11 |
| 2005/0092704 | A1 | * | 5/2005 | Heneveld | 211/87.01 |
| 2005/0230336 | A1 | | 10/2005 | Mundy | |
| 2006/0213845 | A1 | * | 9/2006 | Utshig et al. | 211/41.13 |
| 2007/0210024 | A1 | * | 9/2007 | Haake | 211/149 |
| 2009/0114611 | A1 | | 5/2009 | Munyan | |
| 2010/0102015 | A1 | | 4/2010 | Benneche | |
| 2010/0276241 | A1 | | 11/2010 | Malone | |
| 2010/0307998 | A1 | * | 12/2010 | Chen | 211/184 |
| 2010/0326941 | A1 | * | 12/2010 | Rosenblum | 211/188 |
| 2011/0062095 | A1 | | 3/2011 | Tripodi | |

* cited by examiner

ADJUSTABLE, INSERTABLE SEMI-FLEXIBLE SHELF WITHIN A COMPARTMENT

CROSS REFERENCE TO RELATED APPLICATION

This application is a continuation-in-part of applicant's co-pending application Ser. No. 12/683,381 filed Jan. 6, 2010 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to an adjustable, insertable, attachable and semi-flexible shelf to store items securely within a compartment such as portable coolers, top opening chest freezers, or portable storage containers.

2. Description of Related Art Including Information Disclosed under 37 CFR 1.97 and 1.98

With the advent and growth of outdoor recreation in modern society and added leisure time, the popularity of portable cooled storage compartment devices, otherwise known as portable or compact coolers or ice chests, has increased. The quality of the outdoor recreational experience is often enhanced by easy access to foodstuffs and beverages. To minimize deterioration in foodstuffs and add to the attraction of beverages, it is important that outdoor recreation enthusiasts have access to cold storage. Coolers or ice chests are portable storage compartments which can receive blocks or cubes of ice to maintain cooling of the beverages and foodstuffs stored within during the outings.

The vast majority of these cooler devices have the shortcoming that the foodstuffs can only be kept cold by combining them with the ice placed within the cooler. Typically, portable coolers have just one compartment in which to place both the ice and the foodstuffs or beverages. After a relatively short period of time of usage and storage in outdoor environments, this ice begins to melt causing water to begin forming within the cooler compartment. This melting effect tends to be more prevalent during outdoor recreation as these coolers are typically used in long outdoor trips in the summer and generally warmer weather. The constant opening of the cooler top or opening only increases this process since the cold air is released and the ice is exposed to the warmer outside air. The melting of the ice often has damaging and ruinous effects on the foodstuffs and creates an untidy situation within the cooler. Food and food packages and containers stored within the cooler can easily get wet from the melting of the ice inside of the cooler. Pre-packaged food containers often use cardboard and other materials which are not impervious to water and can result in the contents being soaked in water. Outdoor enthusiasts often use plastic wrap material, paper bags and sandwich bags to wrap up sandwiches and other foods. These covering materials can easily get wet soaking the foods inside, or they can open or unravel resulting in wet and ruined foodstuffs.

Portable coolers are also routinely used by fishermen to store fishing bait and keep it cold during fishing trips. These trips are usually of an extended duration in which the bait must be kept cold to avoid spoilage. Bait in a cooler is typically kept stored in same compartment as the loose ice and subject to the same hazards of getting wet and damaged from water from the melting ice as foodstuffs and foods in containers.

Portable coolers are typically designed to have a large open compartment without any shelves or sub-compartments or other means of segregating items. Due to this typical design, the items within portable coolers can also be difficult to locate and access. This is even more difficult due to the ice covering items. The user frequently has to reach into ice to find and retrieve an item. Once the ice melts, the user has to reach into water to find and retrieve items. It is these problems which are addressed by the present invention.

It has already been recognized that there is a need for the separation of certain food stuffs from the ice used in portable cooling device compartments. It is also known there is a need for better organization of items stored within coolers to allow for better viewing, separation of items and access to items. Examples of known devices in this area include designs of insertable compartments, trays, racks, chambers, and grids to be placed within portable coolers to separate ice and foodstuffs. Examples of such known devices are disclosed in U.S. Pat. No. 4,307,581 to Reid, U.S. Pat. No. 4,424,687 to Morgan, U.S. Pat. No. 4,515,421 to Steffes, U.S. Pat. No. 4,551,988 to Petrantoni, U.S. Pat. No. 4,565,074 to Morgan, U.S. Pat. No. 4,916,923 to Adams, U.S. Pat. No. 5,052,184 to Jarvis, U.S. Pat. No. 5,052,185 to Spahr, U.S. Pat. No. 5,437,165 to White, U.S. Pat. No. 5,605,056 to Brown, U.S. Pat. No. 5,845,515 to Nelson, U.S. Pat. No. 6,050,663 to Schoellmann, and U.S. Pat. No. 6,105,654 to Martel. Typically, these devices consist of internal compartments, chambers, trays and racks which are inserted into compartments. These devices are not built-in to the cooler and are typically removable and adjustable, yet lack the flexibility, functionality and lightness of material of the insertable and semi-flexible shelf apparatus.

Other examples of known prior art include portable coolers designed with many of the above features built-in to the cooler. Examples of such known devices are disclosed in U.S. Pat. No. 5,524,761 to Wayman, U.S. Pat. No. 5,671,611 to Quigley, U.S. Pat. No. 5,816,433 to Higgins, U.S. Pat. No. 6,349,559 to Hasanovic, U.S. Pat. No. 6,782,711 to Abfalter, and U.S. Pat. No. 6,966,450 to Askew. These devices are all designed to separate ice from foodstuffs, but they are all lacking in some manner, primarily that they are not removable, flexible and adjustable in any manner. They also do not make as much use of the limited space within the cooler as compared to the insertable semi-flexible shelf apparatus. These devices also cannot be applied to existing coolers.

It has also been recognized that there is a need to have fishing bait used for fishing activities kept cooled and stored within portable coolers and to keep this bait separated from the ice and the water resulting from melted ice. Examples of such known devices include U.S. Pat. No. 5,605,056 to Brown and Starling, U.S. Pat. No. 5,931,019 to White, and D601,654 to Sykes. These devices employ solid trays to be placed within the cooler compartments with holes to provide cold air to keep the bait cold. However, these trays are not flexible, do not allow as much cold air penetration and cannot be seen through as compared to the insertable semi-flexible shelf apparatus.

It would be particularly useful to develop a device that can be placed inside of portable coolers that will allow for separation of food items and fishing bait from the ice needed to keep these items cool. This device should help to keep the foodstuffs and bait dry from the melting ice and water, which forms in the cooler compartment. It should also provide for easy access to these items and keep them separated from the ice or cooling materials to make them easier to find and retrieve. It should be lightweight so that it doesn't affect the user's ability to carry the portable cooler for any duration. Furthermore, it would be useful for this device to be flexible and adjustable within the cooler so that the user has the most variation in placement of the stored items as they determine and fit a wide variety of sizes currently sold in various retail outlets to the consumer.

Additionally, with the advent of food storage, especially long-term storage of perishable food items, the popularity of refrigerated storage compartments, or freezers, has increased. These units allow for the longer term storage of foods such as meats, vegetables, and other foodstuffs which would perish if stored for long periods in a refrigerator. Often these units are arranged in a top down storage configuration where foods are stored on top of each other horizontally. These units are known as top opening chest freezers or drop-in freezers. Some refrigerators in commercial settings and in boats have this top opening configuration as well.

The top opening chest freezer or refrigerator is opened by raising the top door and reaching in and down to place or remove food items. Frequent door openings to either put objects inside, take them out, or merely to view and find the items inside prior to taking any action causes a major loss of coldness inside the freezer causing food items to be exposed to higher temperatures causing loss of coldness. This condition can also lead to increased energy expenditure and higher energy costs as the generator units of freezers have to activate on a more frequent basis to maintain freezing temperatures. This same condition of loss of cold air from frequent door openings is also well known to be a problem facing users of household refrigerators. Foodstuffs within these drop-in freezers are also often stacked or piled vertically with limited ability to organize or find certain foods. This can make it difficult to find desired objects or even to be able to see what is inside the freezer. Thus, users have to keep pulling out objects to find the ones they want, all the while losing precious cold air from the freezer, resulting in higher energy usage.

It has already been recognized that there is a need for better organization of storage of items within freezers and refrigerators in many different settings to improve the viewing, locating and retrieval of food items. Examples of known devices in this area include racks and trays within freezers to enable organization and placement of objects. Examples of such known devices are disclosed in U.S. Pat. No. 3,083,836 to Bussemer, and U.S. Pat. No. 4,138,175 to Tattershall. These devices are typically made of metal or solid material and inserted within the freezer cabinet. They do not have the flexibility and ease of use of the insertable, semi-flexible shelf apparatus.

It would be particularly useful to develop a device that would be able to retain items within a refrigerated or frozen cabinet such as with household top chest or drop-in freezers or refrigerators to enable better access to some items and keep certain items such as foodstuffs and food containers separate and easy to view, find, and access to place or remove as needed. The more frequently a freezer door or cooler cover is opened, the greater the loss of cold air. This leads to higher temperatures in the internal storage area, which results in higher energy use required to maintain adequate coldness.

Additionally, in recent years, the popularity of portable storage devices, such as plastic, stackable storage bin containers, has become more widespread. These devices are frequently used by people who have limited storage capabilities in their homes, and by people who frequently need to move or haul items from one place to another. These units typically take the shape of large rectangular bins, with a width and depth of a few feet, providing for substantial storage capability while still allowing easy portability by one person in transit. As with portable coolers or drop-in freezers, the functional limitation of these containers primarily involves the lack of ability to separate and segregate items for effective viewing, storage and retrieval of items. Typically within these containers, items are loose and have a tendency to become mixed together, trapped under and within other objects, and become difficult to locate and retrieve. This becomes more pronounced when it comes to small or more valuable items which can be even harder to find and more difficult to replace. Other items that are more fragile and breakable can be protected from possible damage from excessive movement within or by contact with other materials within the compartment. This tendency to lose items within compartments is increased by the frequency of movement since these units are designed to be portable. An attachable, insertable and flexible shelf allows for retention, segregation, and easy viewing and retrieval of certain objects and items within these types of containers.

It has already been recognized that there is a need for improving the organization of storage of items within portable storage containers. Examples of known devices in this area include storage compartments with certain tray and shelf components built-in. Examples of such known devices are disclosed in U.S. Pat. No. 5,011,013 to Meisner, U.S. Pat. No. 5,123,564 to Hobson, and U.S. Pat. No. 6,874,650 to Welsh. These devices are compartments that have some tray and shelf features built-in, but they are not separate insertable or attachable trays that can be used with the majority of existing storage containers.

It would be particularly useful to develop a device that would be able to retain items within a portable storage compartment to enable better viewing of and access to certain loose items, especially items that are small, fragile, breakable, and more valuable. It would be additionally useful if this device was constructed of lightweight flexible material and could be easily insertable and attachable within portable storage containers and also easily removable.

BRIEF SUMMARY OF THE INVENTION

The preferred embodiment of the present invention includes an insertable semi-flexible, adjustable shelf to be deployed inside of a portable cooler, freezer compartment, or portable storage compartment and secured to the inside walls of the compartment. The shelf is attachable and removable and designed to hold items securely and separately in order to make for easy access and to prevent the items from combining with other items, including water or ice.

The shelf is constructed primarily of thin and lightweight flexible material, such as nylon mesh, and is not rigid. This flexibility allows it to adjust to objects being stored both within it and underneath it within the compartment. The shelf is designed to be securely attached to the compartment and to hold items of sufficient weight, such as foodstuffs, fishing bait, and assorted loose objects, which need to be separated from the rest of the items within the compartment. The shelf is also designed to be easily removable from the compartment by the user. The shelf is designed to cover the majority of the compartment leaving an opening through which a user may easily place and remove items underneath in the main body of the compartment. The shelf has a retaining wall on the side bordering the opening to keep the items placed on it from falling into the main body of the compartment. It also has a partition, which can be attached or removed as desired by the user to separate the shelf into two compartments.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

An adjustable, insertable, semi-flexible attachable and removable shelf designed to fit inside of a drop-down compartment such as a portable cooler or ice chest, drop-in freezer or portable storage bin. The shelf is made of nylon mesh material generally surrounded by a nylon border. Shelf will serve to keep items residing on it separated from the main body of the compartment for easy viewing and access. The shelf also serves to protect items from other items in the compartment, such as ice or water from melted ice within a portable cooler or freezer. A partition running the horizontal length of the shelf will also serve to give the user some further separation of items stored on the shelf. The nylon mesh construction will serve to allow air flow to items on the shelf so as not to impede cool air circulation for items stored on the shelf within portable coolers or freezers. This shelf is supported and suspended inside the compartment with fastener elements in the form of a hook and loop system described herein which gives its additional support and adjustability.

In storage bin use, the shelf will serve to keep smaller, breakable, fragile, and more valuable items separated and protected, free of the general storage below in the main compartment.

Figure 1:
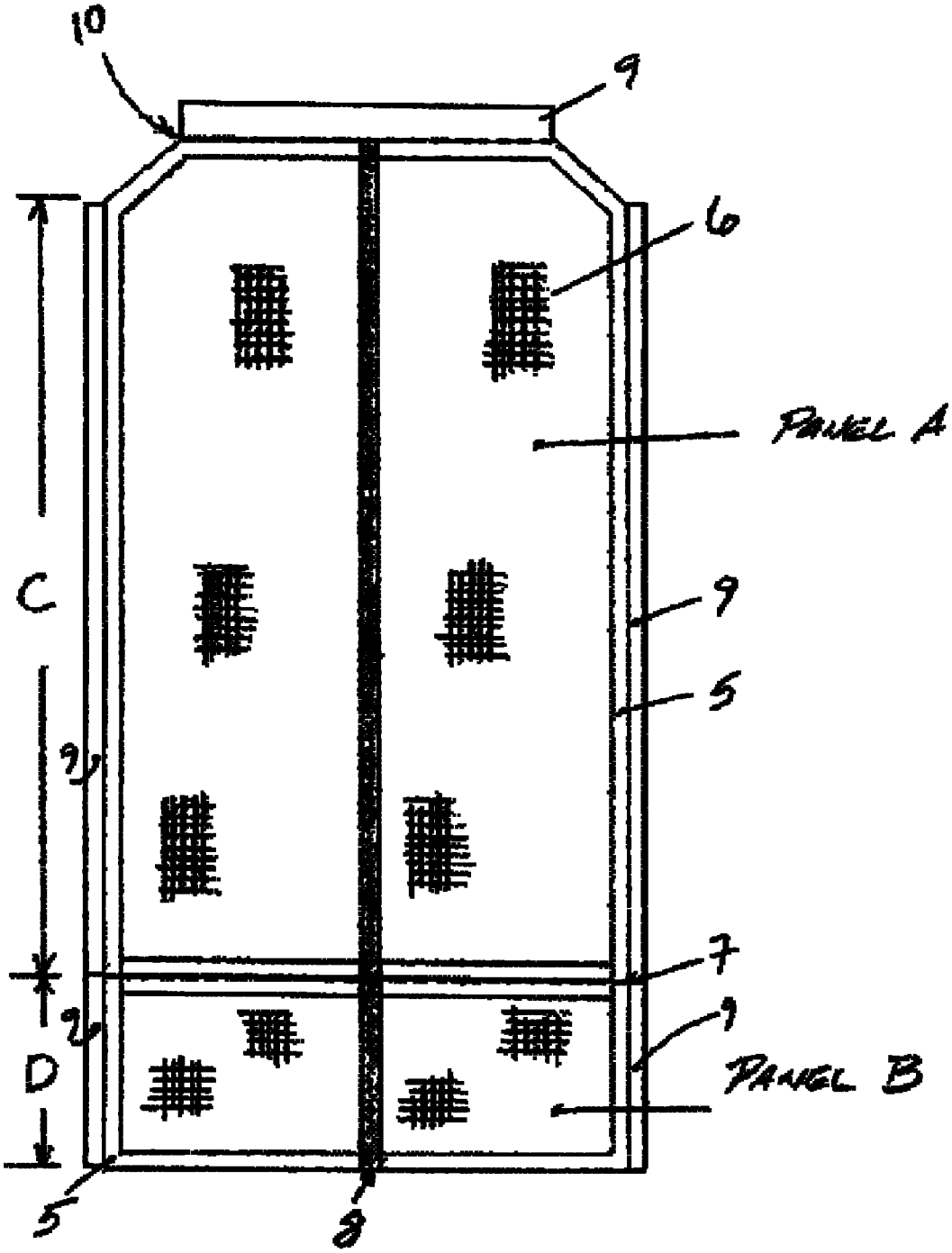
FIG. 1 is a top view of the main body of the shelf surface (Panel A) and the retaining wall (Panel B) depicting the shelf to be inserted and deployed within a compartment.

FIG. 1 represents the main body and horizontal surface of the shelf and also the retaining wall of the shelf invention. Two mesh panels, A and B, are separate by seam 7, which is stitched into the fabric so as to separate the two mesh panels. In use, Panel B is positioned in a vertical fashion perpendicular to Panel A and serves as a retaining wall of the device on the sole side of the shelf not attached to the compartment. The retaining wall is an integral part of the shelf and serves to block the items held within the shelf from falling into the main body of the compartment. Seam 7 serves as a virtual joint or hinge between the two mesh panels.

Border 5 is sewn into the entire perimeter of the outside of the nylon mesh netting material 6 of the shelf body.

Item 9 is a flap strip, which serves as a mounted fastening element, which is separated by seam 10, and has loop material sewn into its backside. It is made of the same nylon mesh material as the border 5, however, it is void of any mesh material on its interior. This allows for the flexibility of item 9, which in use is positioned approximately 90 degrees to the body of the shelf vertically. The loop material on the backside of item 9 is ultimately fastened to another strip of adhesive hook material running the length of item 9 that is adhered to the inside wall of the compartment. This strip is positioned below the top opening on the inside wall of the compartment and above the body of the shelf as to allow the shelf to hang in this hook and loop relationship. This serves as anchoring for the shelf and support of the shelf, Panel A.

Figure 8:
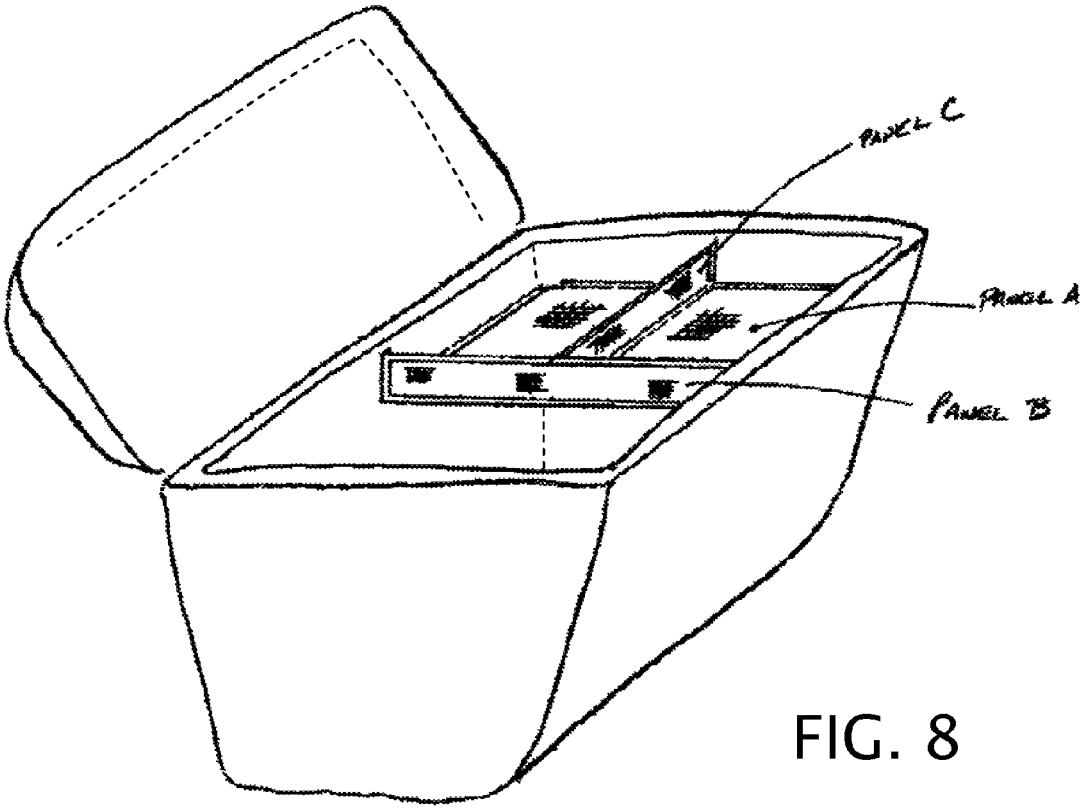
FIG. 8 depicts the entire shelf apparatus, including the center partition, installed in its intended location within a compartment.

Item 8 of FIG. 1 is a strip of hook material, which serves as a fastener element sewn into the midline of the shelf device and functions as the anchoring mechanism of the shelf partition, shown in FIG. 8. The partition is an attachable and removable partition separating the shelf into two sections along its horizontal plane for separation of items stored on the device. It runs the raised vertical distance of Panel B and the horizontal length of Panel A to the limits of the border 5.

Figure 2:
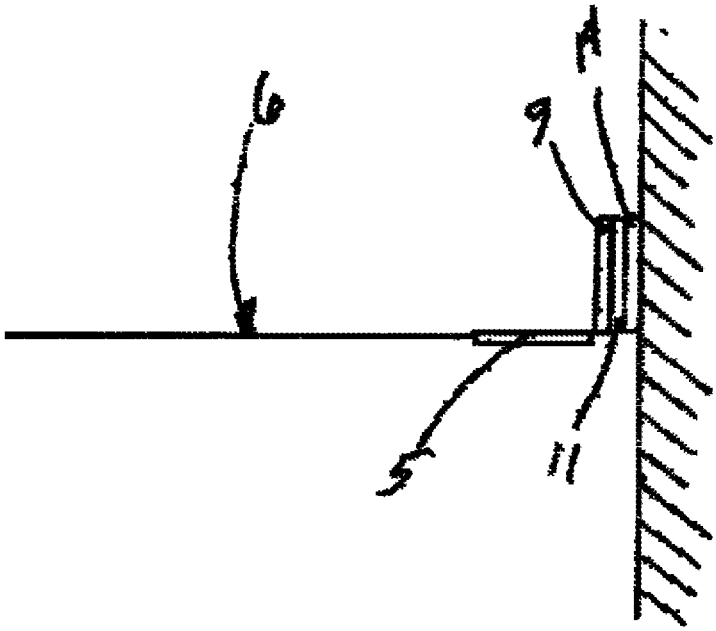
FIG. 2 is an enlarged top view depicting the means of attachment of the shelf to the inside of the compartment.

FIG. 2 is an enlarged side view looking down the length of a side of the shelf and shows how the shelf would affix to the wall of a compartment. It depicts built-in flap strip item 9 as a fastener element at the point where it would attach to the wall of the compartment. It also shows how the flap strip of item 9 of FIG. 1 attaches to the wall of the compartment. Item 14 is the loop material adhered to the wall of the compartment and has fastening elements in the form of hook material 11 fastened to it, which is sewn into the backside of item 9. Item 9 is a built-in flap strip that is part of the body of the shelf and is sewn into the border 5. Item 5 is the border of the shelf and item 6 is the mesh material, which makes up the body of the shelf. This would also be a top view, looking down the wall/partition and its attachment to the side wall vertically.

Figure 3:
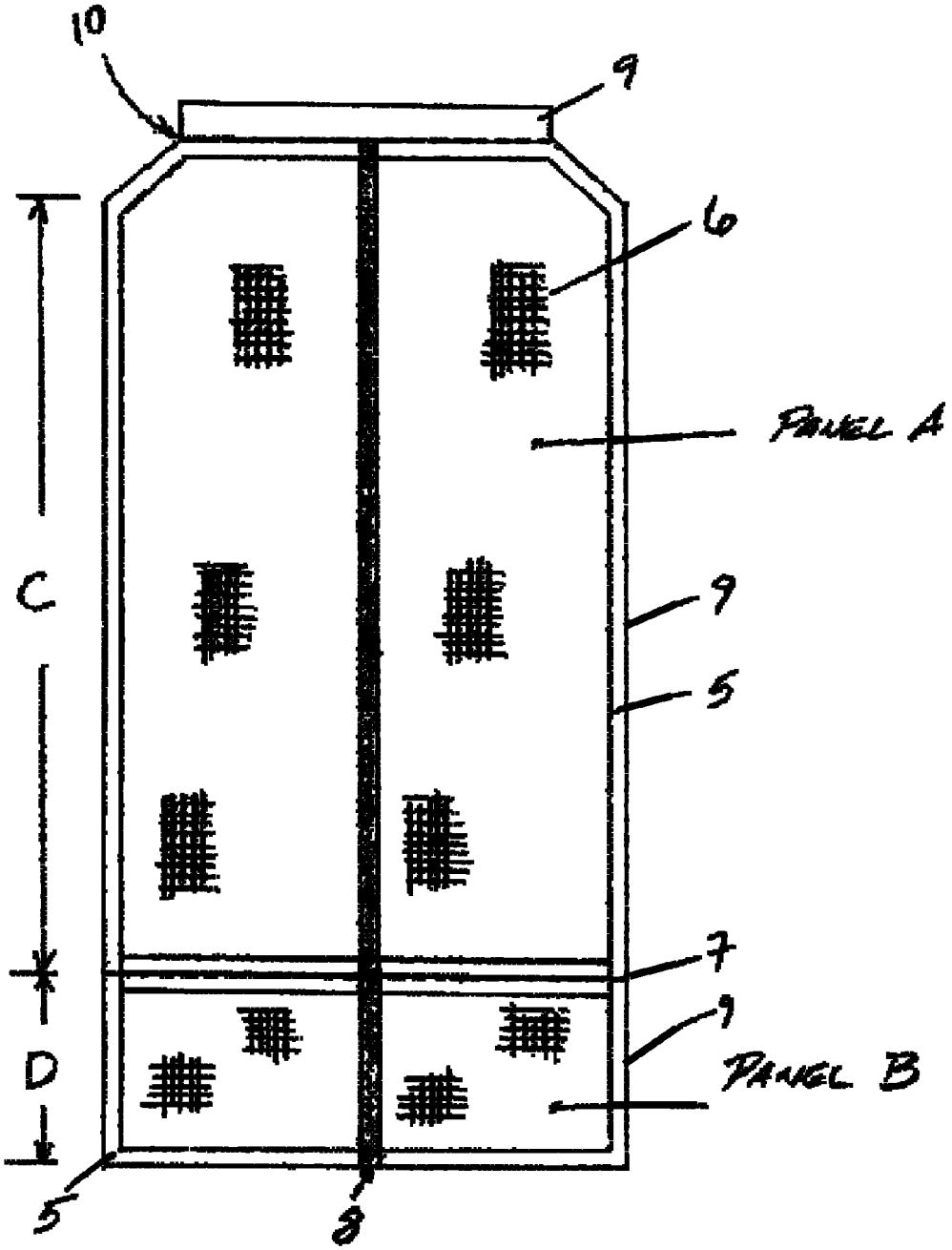
FIG. 3 is a top view of the main body of the shelf surface (Panel A) and the retaining wall (Panel B) with the built-in shelf flaps removed, so as to be used with the separate attachable flaps to make up for the variability of compartment openings.

FIG. 3 is similar to FIG. 1 in that it represents the main body and horizontal surface of the shelf and also the retaining wall of the shelf invention, however it does not include the built-in flap strips along the length of the shelf. This embodiment is to be used with the separate attachable flaps (of which one is shown in FIG. 4) to be attached along the length of the shelf for use in attaching the shelf to fit in compartments with varying opening dimensions.

Figure 4:
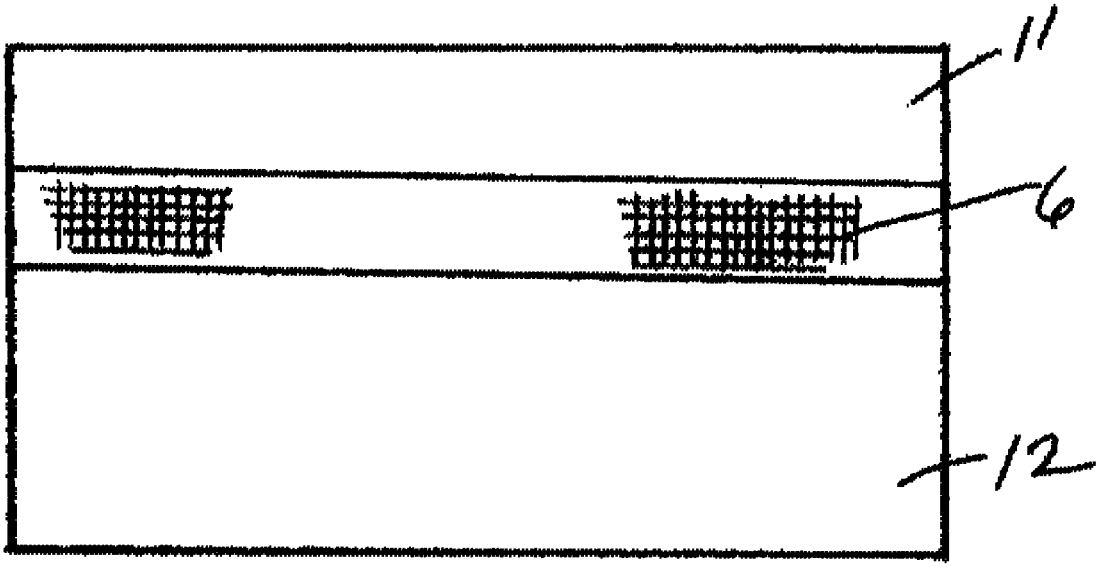
FIG. 4 is an enlarged view of the separate attachable flap to be used to make up for the variability of compartment opening sizes.

FIG. 4 depicts the separate attachable flap used to make up for the variability of the dimensions of various compartments to allow for installation of the shelf in them. It is a separate rectangular piece of nylon mesh 6, made of the same material as the body of the shelf and has hook material 12 sewn onto one side of its entire horizontal edge and on the opposite side has loop material 11 sewn into its entire horizontal edge. Separate flap will be used to bridge the distance between the edge of the shelf length and the inside compartment walls where there is an absence of item 9, along the distances designated C and D in FIG. 3. The extra-wideness of the hook material 12 would be how variability is achieved. As it would marry to the bottom side loop material fastened the border material 5 on the both edges of panel's A and B, it would serve to bridge the varying distances between the walls and the item in the various sized compartments. The extra-large surface area would marry the loop on bottom surface on both the horizontal plane of the shelf body and the upright partition and one would adjust the placement of the flap according their needs according the distance between said walls and shelf body.

Figure 5:
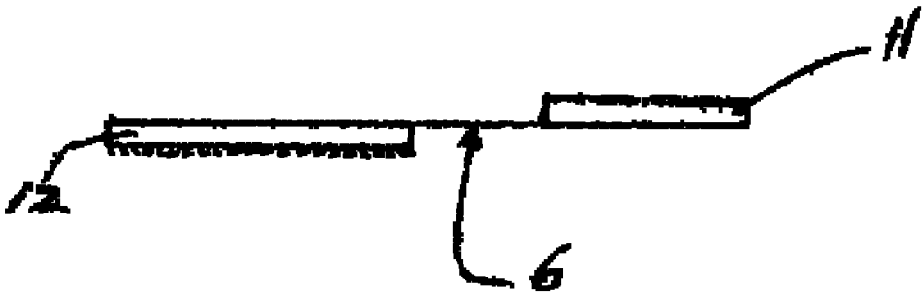
FIG. 5 is a cross-section side view of the separate attachable flap looking down its horizontal plane.

FIG. 5 shows the separate attachable flap from a cross-section side view looking down its horizontal plane. Hook material 12 is shown facing downward and hook material 11 shown facing upward. Both are sewn into the mesh material 6 of the shelf.

Figure 6:
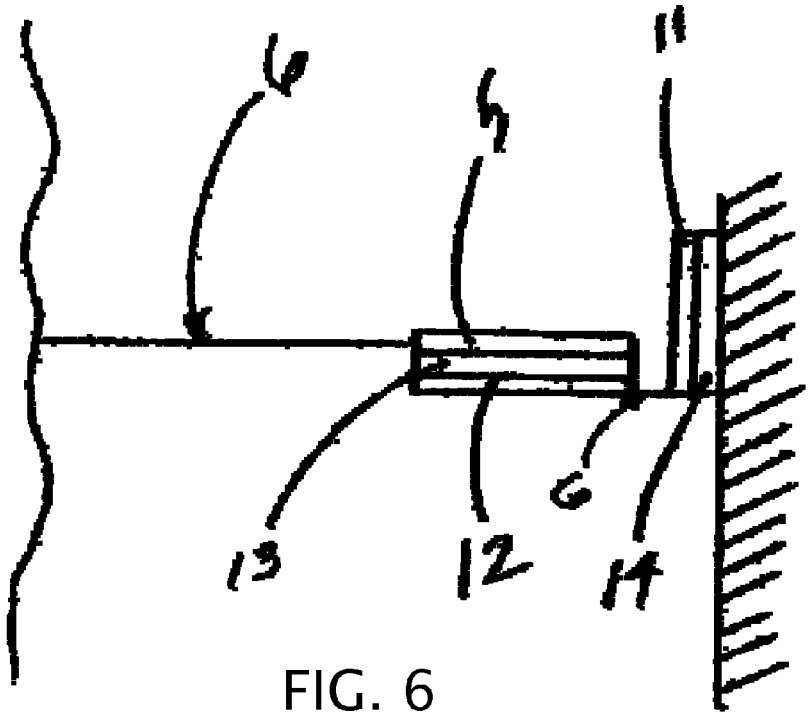
FIG. 6 is an enhanced side view of the shelf body attached to the separate attachable flap horizontally and the flap attached to the inside compartment wall vertically.

FIG. 6 shows how the shelf is affixed within the compartment using the separate attachable flap and is attached to the inside wall of the compartment. Hook material 12, sewn into mesh material of the flap (6), is married to loop material 13 which is sewn into backside of the border 5 which surrounds mesh material 6 of the device. On the adjacent side of the flap, the hook material 11, sewn into the mesh material 6 of the flap, marries to the strip of adhesive loop material 14 that is adhered to the wall of the compartment.

Figure 7:
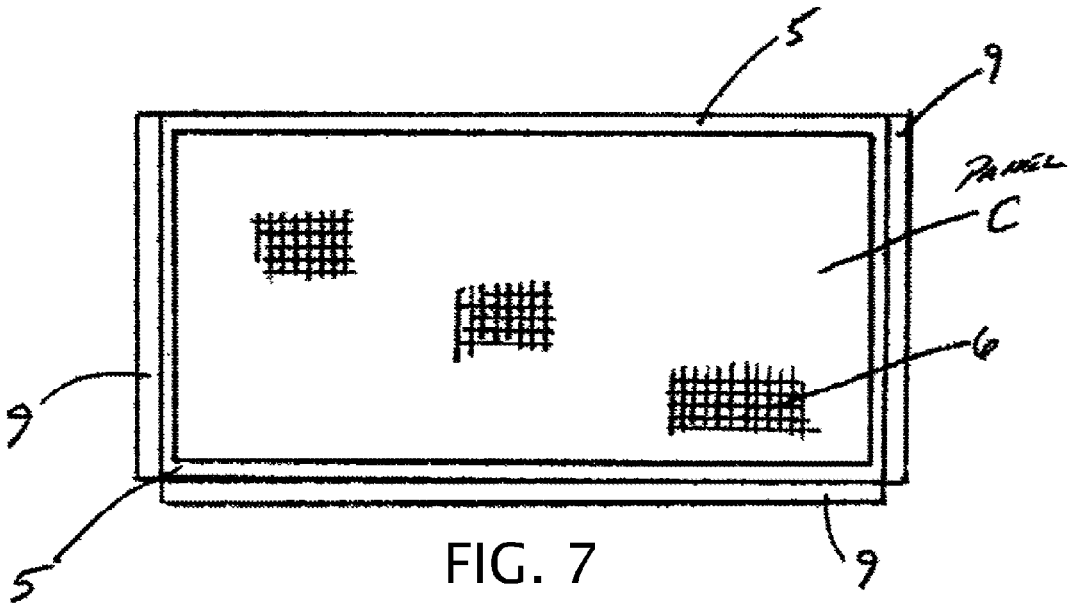
FIG. 7 is an enlarged side view of the partition (or Panel C) of the shelf.

In FIG. 7, the partition (or Panel C), is made of the same nylon mesh material 6 as the shelf body and bordered on all sides by the same nylon material as the shelf border 5. Item 9 has hook material sewn into its backside. The vertical edge of one side of item 9 will fasten to the vertical distance D of the loop strip 8 mounted to Panel B (of FIG. 1). The opposite side of the flap strip of item 9 will marry to the strip of adhesive loop material fastened to the inside wall of the compartment running the vertical distance of FIG. 3 which is the same distance D in FIG. 1. The bottom backside hook material of item 9 will marry to the loop material of hook strip 8, FIG. 1, from seam 7 to seam 10.

FIG. 8 shows the shelf with panel C, the partition, in its intended position installed within a compartment. The partition allows for items to be separated from each other within the shelf itself.

In order to give this device a bit more rigidity, plastic stays are sewn into various places. Stays are sewn into the entire length of the partition's (Panel C) bottom and top edges. The stays are sewn into the material of the border 5 on its interior. Thus, the stays are embedded and hidden. This gives the device added strength and rigidity along its length running parallel to the walls of the compartment running lengthwise. Two more stays are sewn into the width of the device on the top and bottom borders of the retaining wall, or panel B. These enhancements give it added strength and rigidity along its width.

Figure 9:
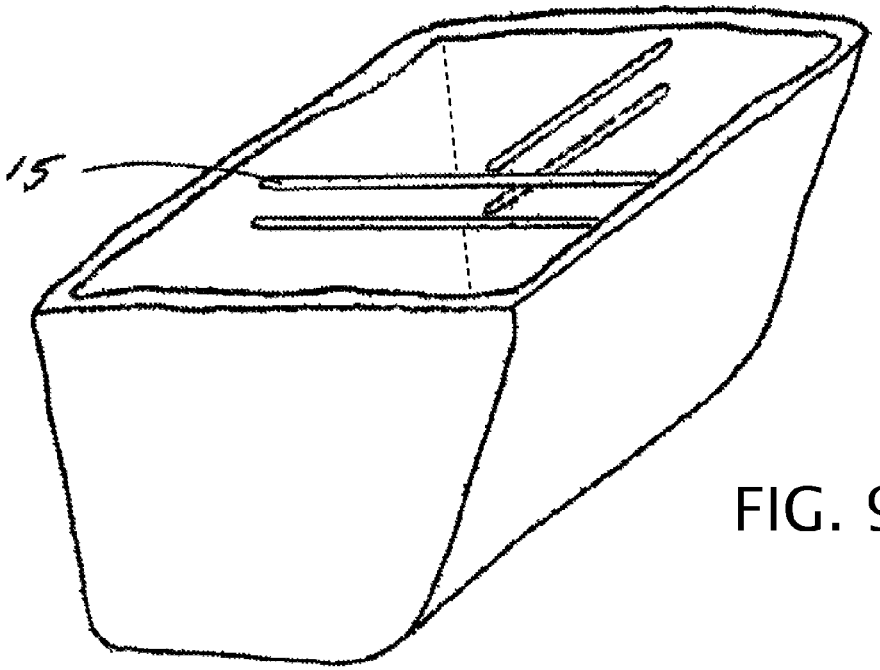
FIG. 9 is a depiction of the approximate location of the embedded stays of the retaining wall and partition of the shelf in its installed position inside the container.

FIG. 9 shows the location of the stays 15 and their approximate locations when embedded in the device as installed within a compartment. In this FIG. 9, the device has been erased leaving only the stays for their proper location in regards to the compartment.

Figure 10:
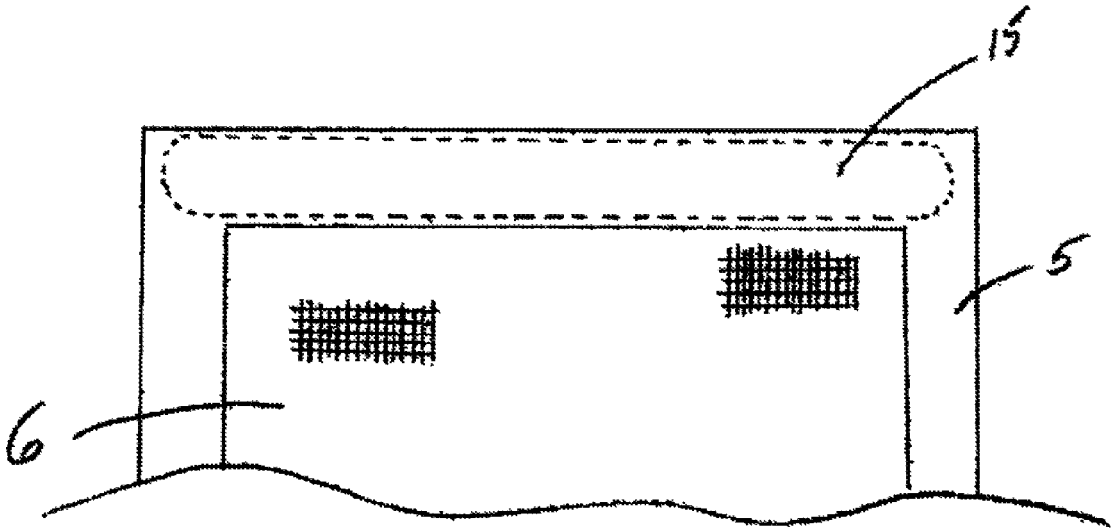
FIG. 10 is an enhanced cutaway view of the stay as embedded within the top border of the retaining wall and partition of the shelf apparatus.

FIG. 10 is an enhanced cutaway view of the shelf border that shows the stay 15 embedded in the border of the device shown by the dotted lines.

Figure 11:
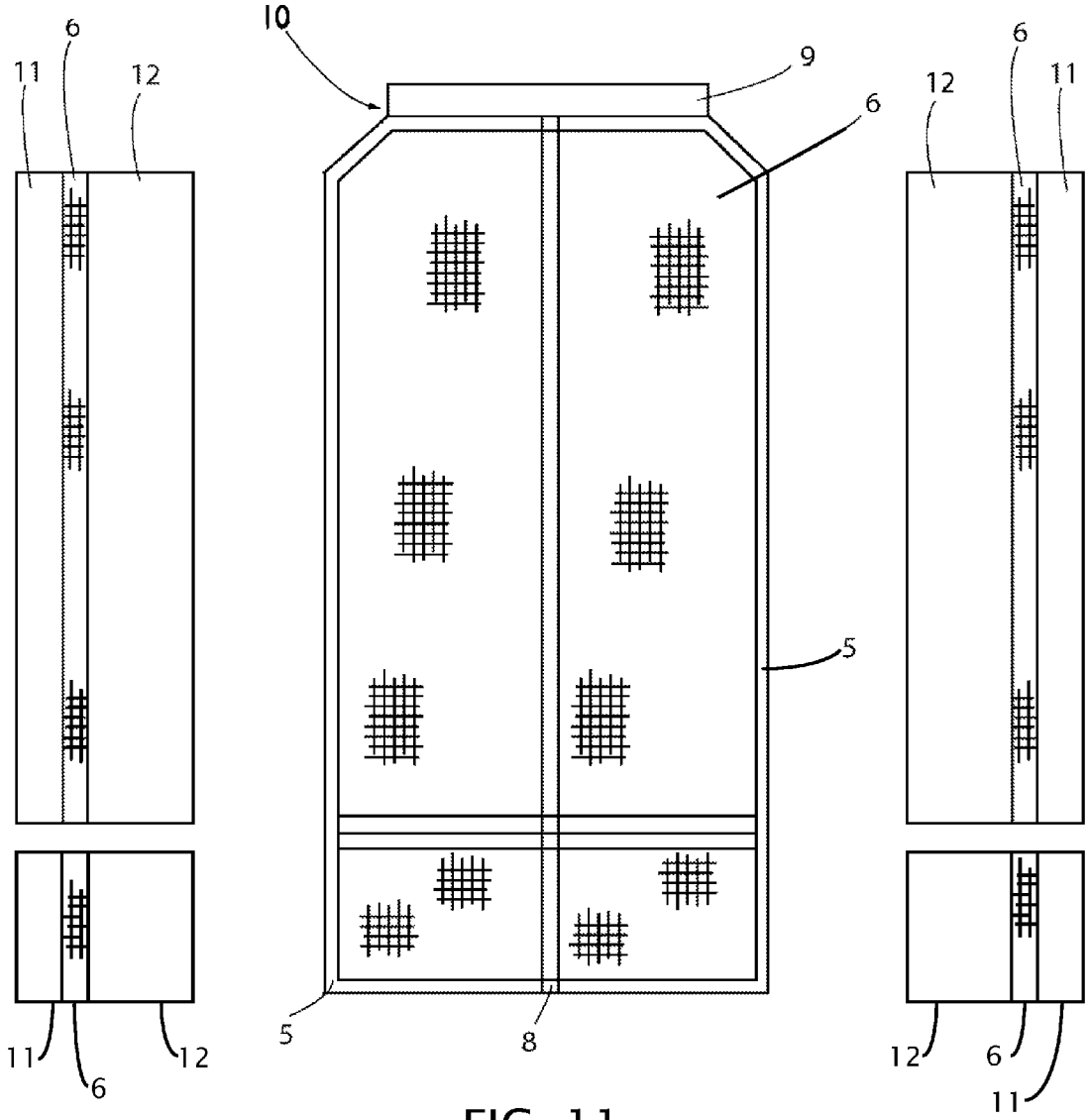
FIG. 11 shows the shelf with flip up wall panel of FIG. 1 with a flap as seen in FIG. 4 adjacent to each side of the shelf.

In FIG. 11, the panel A is seen with the strip of FIG. 4 seen adjacent to each side. This illustrates the relationship of the main panels and the strips for adjusting to accommodate container of varying widths. While the flaps on the outer sides are shown as separate they can be sewn or fabricated as a single piece with the main panel.

Figure 13:
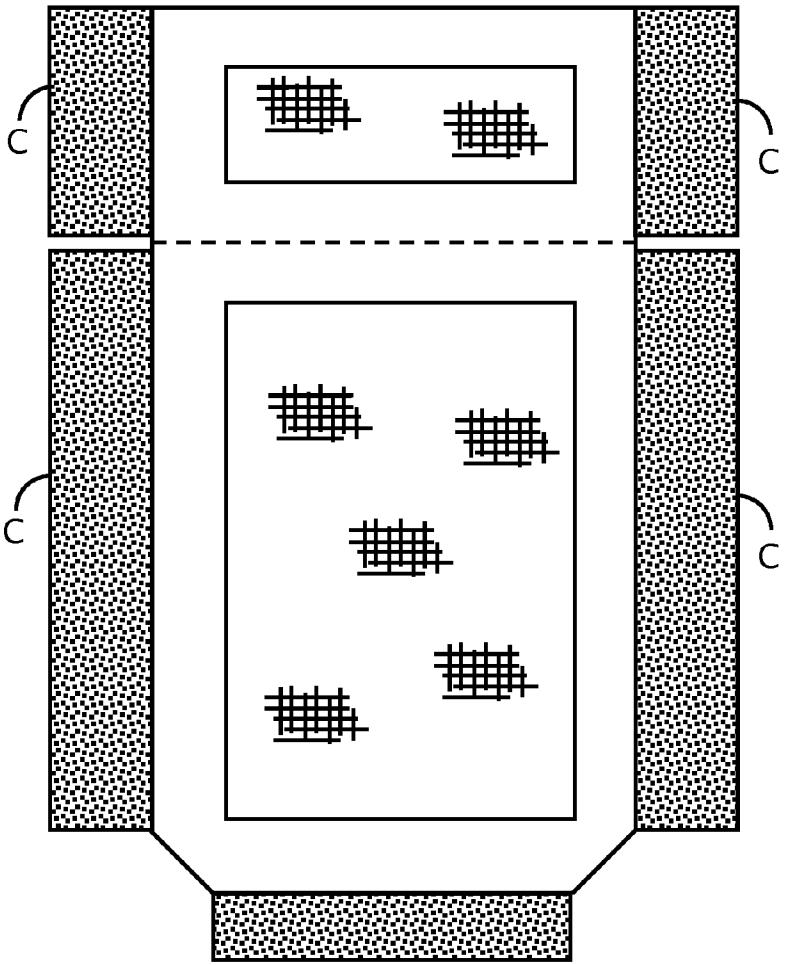
FIG. 13 is a bottom view of a second embodiment of the shelf.
Figure 12:
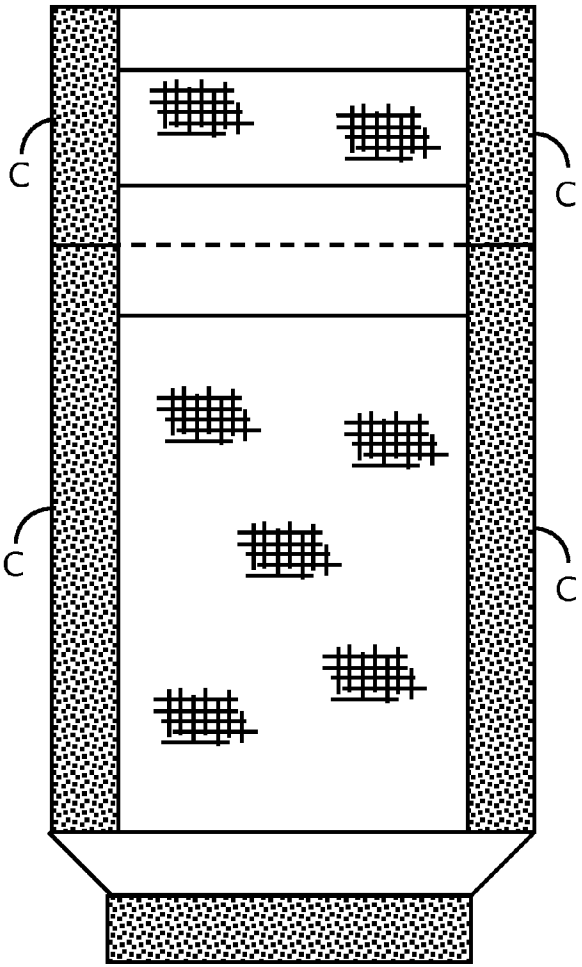
FIG. 12 is a bottom view of a first embodiment of the shelf.

FIG. 12 is a bottom view of a first embodiment of the shelf and FIG. 13 is a bottom view of a second embodiment of the shelf. Where the loop fastener C was secured right to the bottom in FIG. 12, and the associated removable flap was used, it is shown extended in FIG. 13. The PVC tarpaulin is extended beyond the existing edge to keep it one piece and fairly wide which creates the adjustability. Whereas in FIG. 12 loop material was sewn into the border on the bottom side and associated hook material on the removable flap was married to it, hook material is now sewn right to the extended PVC material, on the bottom side, where the entire main panel and sides flaps are made as a one piece unit and attach directly to the associated loop material adhered to the sidewall of the compartment.

Figure 14:
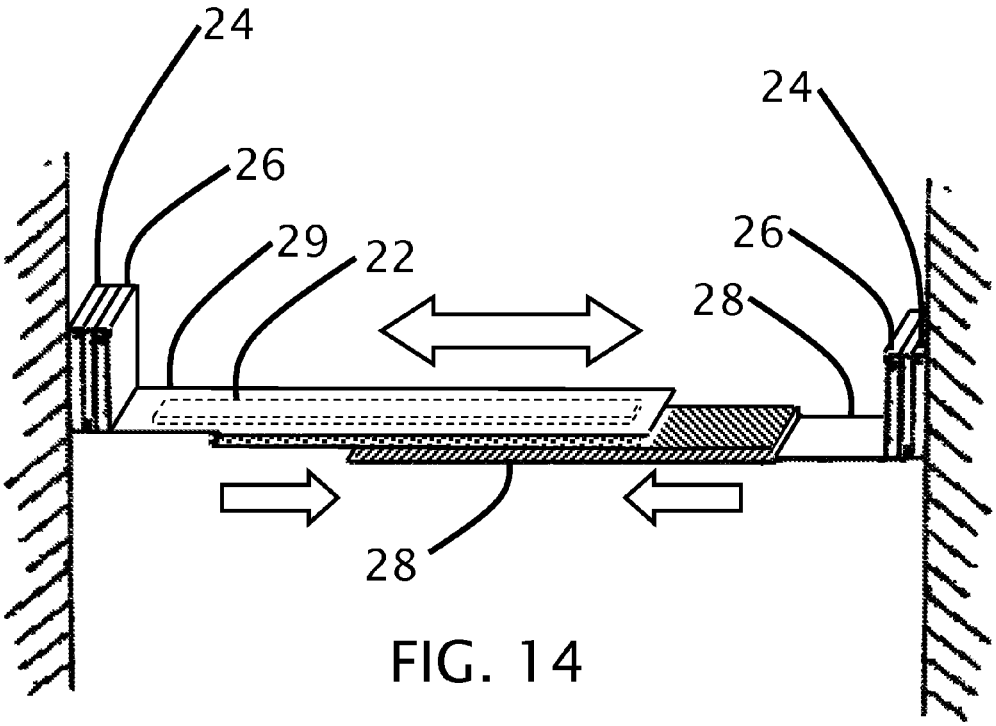
FIG. 14 shows an adjustable strap.
Figure 15:
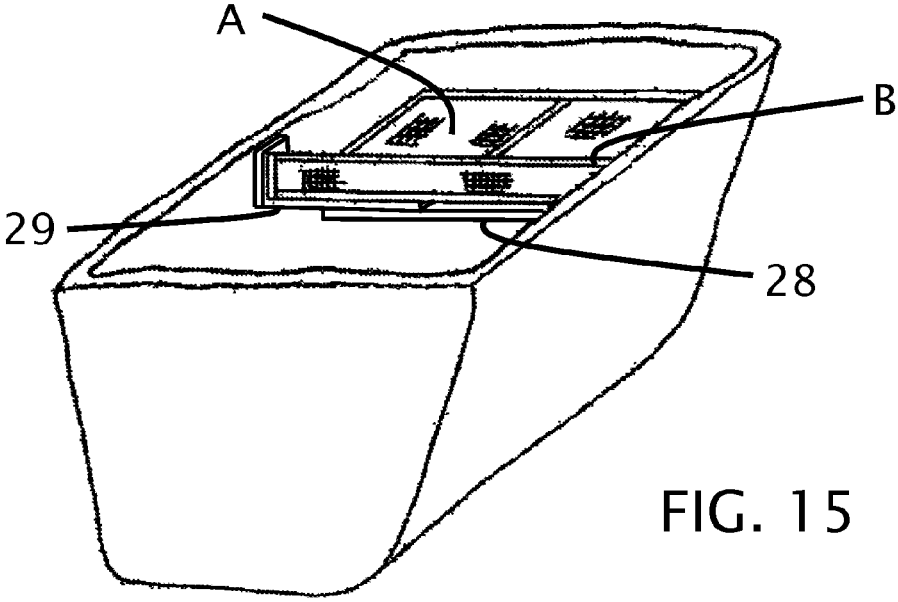
FIG. 15 shows the adjustable strap from FIG. 14 supporting the removable shelf.

FIG. 14 shows an adjustable strap and FIG. 15 shows the adjustable strap from FIG. 14 supporting the removable shelf. The adjustable strap is essentially formed from to separate pieces 28 and 29 that have complementary hook and loop fasteners secured to elongated length of each separate piece 28 and 29. The connection between the complementary hook and loop fasteners allows for adjustment of the strap between the side walls of the container to support the removable shelf panel A. The adjustable strap is shown supporting under panel A, but the adjustable strap can be positioned at other locations along the inside of the container as well as multiple adjustable straps can be placed under the removable shelf.

In FIG. 14, the adjustable strap 28 and 29 have hook material 26 sewn into their respective ends which marry to loop material 24 which is adhered to the respective opposite walls of the compartment. One would then adjust by moving distal ends of 28 and 29 straps with complementary hook and loop so as to join the two strips making one supporting strap under the shelf body A. It is contemplated that within the elongated section of the adjustable strap that plastic or metal stays 22 can be integrated to provide structural support and reduce sagging of the adjustable strap under weight of items placed onto panel A.

It would become apparent to anyone skilled in the art to make this device out of any material that would solve the aforementioned issues. It could be constructed of a more rigid material such as wood, hard plastics such as Plexiglass.®, an acrylic material, manufactured by various manufacturers, a registered trademark of Arkema France Corporation, Colombes, France. It could also be made of a more flexible material such as vinyl or plastic.

Furthermore, one might choose to fasten the device to the compartment using such fasteners as snaps, screws, or gluing the device directly to the compartment.

One might even choose to make a device void of partitions or any compartmentalization or even add more vertical panel partitions to make more compartments. One might choose to fasten the partition divider to the shelf by other means such as snaps, hooks, latches, etc. One may also wish to make the partition permanently installed by the use of adhesive, sealant, or by sewing it to the shelf and the retaining wall. Anyone skilled in the art might even choose to make the shelf's retaining wall facing the open end of the compartment, Panel B, a removable partition or wall. A lid to fit on top and enclose the shelf might even be deployed so as to keep the items from falling out should the compartment topple over.

One might even choose to make a device with some means of access provided in the shelf body itself to be able to reach down through the shelf into the lower compartment below, such as a zipper running the length of the shelf at its midpoint. This access could be also provided by other means such as snaps, hooks, latches, etc. One may also wish to make the shelf body cover the entire length and width of the compartment to provide more storage space on the shelf, attaching to the entire perimeter of the inside compartment walls.

We have chosen to use the hook-and-loop material attachment system so as to give the device a removable and easy to stow benefit. Being able to easily remove the shelf will aid in the cleaning, loading, or emptying of any compartment. Once removed, the only remaining pieces would be the adhesive strips of hook material that had been adhered to the walls of the compartment.

It will be appreciated that the nylon mesh material, the main body of the shelf (Panel A), the retaining wall (Panel B), the partition (Panel C), the flap attachments, and strips of adhesive hook-and-loop material of the present invention may be manufactured and packaged together for distribution, for instance, separately in retail stores or included within portable coolers, drop-in freezers, and portable storage bin containers to be purchased. The device will be provided in various sizes to fit various containers.

For shelf devices not pre-installed within a compartment, a user may then purchase the package which may also include an adhesive or bond, or in some instance, may include the strip of adhesive-backed hook-and-loop material fabricated with an adhesive back side thereof and covered by a peel off cover strip.

The user will purchase the shelf device of a size which may complementally fit the access opening or openings of his or her portable cooler, freezer, or storage compartment and can readily install the device by peeling the cover strip off the backing off the strips of adhesive-backed hook material and adhering the respective strips to the inside walls of the portable cooler, freezer, or compartment in spaced relationship around the opening.

It will be appreciated that the user has the option of, prior to installation, sizing up the arrangement by placing the shelf temporarily within the compartment opening and positioning the respective flap attachments in the approximate intended locations to determine where these flaps will need to be adjusted and secured by means of the strips of adhesive-backed loop material to secure a tensioned condition for the shelf.

The manner of installing the current embodiment is for the user to first unpeel the plastic backing off the strips of adhesive-backed loop material supplied with the embodiment and then apply these strips to the inside walls of the compartment. These strips would need to be mounted to the internal sides of the compartment so that the flaps could then secure the shelf in place over the top of the compartment. Once these strips are secured, the user would then attach the flaps, if necessary, by means of securing the hook and loop material on the flaps to the hook and loop material on the adhesive strips. Once secure, the user would attach the shelf to the flaps and then adjust flaps as needed to properly fit the desired compartment.

The user would then raise the retaining wall at the edge of the shelf and attach the hook material of the wall to the loop material attached to the inside walls of the compartment. Finally, the user would attach the partition horizontally along the top surface of the shelf, securing it to the shelf by means of the hook-and-loop material mounted to both the partition and the top of the shelf. The partition is then also attached to the inside of the compartment wall and the midpoint of the retaining wall.

Once installed, the user would then only need to place items on the shelf or take items off to use it. If not pre-attached to the horizontal midpoint of the shelf, the user could attach the partition by mounting the hook material on the flap on the lower section of the partition to the loop material of the body of the shelf along its horizontal midpoint. To finish the installation of the partition, the user would attach the hook material on the edge of the partition to the loop material on the midpoint of the raised retaining wall. The user can then put different types of items in either of the two created sub-compartments within the shelf. The user could then choose to remove the partition, which separates the shelf horizontally into two equal sub-compartments by grabbing it at either end and pulling it to detach it from the hook-and-loop material. The user can maneuver items around the shelf by placing items below the shelf in the base of the compartment. The user can choose to completely remove the shelf in order to place larger objects within the compartment, to clean the shelf, or to clean the entire compartment, by simply detaching the loop material affixed to the shelf and its flaps from the hook material affixed to the inside walls of the compartment.

Advantages

From the foregoing it will be appreciated that the shelf of the present invention provides for easy, convenient and inexpensive installation. It is positively secured in place by hook-and-loop attachments adhered to the inside vertical walls of the compartment by adhesive strips to positively secure the shelf in place against dislodgement. The strength of the attachment by using industrial quality hook-and-loop material will also prevent dislodgement by the weight of any items stored on top of the shelf in the compartment formed by the shelf in normal usage, including movement or transportation. Another advantage of this hook-and-loop attachment is that by incorporating its use in the design, the shelf can be easily detached by the user and then stowed within or without the compartment while not significantly reducing storage capability of the compartment.

Further, the use of the nylon mesh material for the shelf allows for cold air to pass through the material since the mesh material is porous and not solid, such as occurs with plastic alternatives. Thus, foodstuffs and fishing bait placed on and within the shelf can remain adequately cooled when used in a cooler or drop-in freezer. A solid tray or shelf within a cooler or freezer would cause cold air flow to be blocked. The nylon mesh also allows for viewing of the items stored below the shelf within the cabinet. Other similar shelf or tray units are often solid and the user has to lift them out to see into the compartment below.

In addition, the nylon mesh is beneficial in that it is flexible, unlike solid trays, and items may be placed all around and beneath it. The flexible mesh material of the shelf has some give, allowing items to slightly alter the shelf's horizontal plane and raise it while not elevating the shelf to the point of impeding the closing of the compartment. Another benefit to the shelf being constructed of mesh material and flexible, is that by not being solid, it will not break or crack under pressure or applied force. This nylon mesh material also provides a benefit in that it is lightweight so that it does not add significant weight to portable compartments.

Furthermore, it will be appreciated that the insertable shelf of the present invention provides for the utility of storing food items or fishing bait within a portable cooler or drop-in style freezer without these foodstuffs being ruined by getting wet or overly frozen by falling into the main body of the compartment. Ice within portable coolers melts and the foodstuffs can often get wet and soggy if the packaging or container material is not waterproof and uses material such as cardstock or paper products. Furthermore, if the opening of the food packaging is breached, the foodstuffs may be exposed to the melting ice water. In a freezer, foodstuffs may be exposed to ice and become overly frozen if the packaging has an opening or is made of non-waterproof material.

Another advantage of the shelf device is that by providing sub-compartments above and partitioned from the rest of the chamber, it allows a user to more easily find certain items so that the user does not have to search the entire contents to find these items, whether in ice, water, under other foodstuffs, or any other items beings stored. The partition allows the user to separate multiple items from the main body of the compartment and each other. This advantage applies to usage in portable coolers, freezers, and storage containers. Additionally, by shortening the amount of time required to find certain items, this will allow for shorter durations of openings for portable coolers or freezers, lessening the amount of cold air escaping. Thus, in the example of coolers, the ice will be able to cool the foodstuffs inside for a longer duration. These coolers are often used during warmer times of the year for outdoor recreation and enjoyment, therefore frequent opening of the cooler cover causes the ice to melt faster than it normally would. In freezer units, saving the amount of time the unit is opened would equate to lower energy costs to generate sufficient cold air to freeze the items.

The inclusion of attachment flaps between the shelf and the compartment allows for adjustment to fit many different sizes and shapes of units, so that the shelf can fit more snugly and adequately cover the area and prevent objects from falling. The flaps also allow the shelf to be placed in multiple coolers or freezers without being permanently affixed to one single particular unit.

CONCLUSION, RAMIFICATIONS, AND SCOPE

Thus the reader will see that at least one embodiment of the device provides an easy-to-use yet effective means of storing items in a flexible shelf, keeping them dry, separate and easily available for viewing, access and use. While the above description contains many specificities, these should not be construed as limitations on the scope, but rather as an exemplification of one preferred embodiment thereof. Many other variations are possible. For example, the nylon mesh of the shelf body could be constructed of other materials, such as plastic sheeting, acrylic sheeting, vinyl, other nylon, etc. each having various abilities to act as a compartment shelf.

The retaining wall of the shelf could be constructed of other materials, such as plastic sheeting, acrylic sheeting, vinyl, etc., each having ability to act as a retaining wall and keep items from falling off the shelf.

The partition, mounted to the shelf, could be constructed of other materials, such as plastic sheeting, acrylic sheeting, vinyl, etc., each having various abilities to act as an upright partition and separate items on and within the shelf.

The fastener elements of hook-and-loop material and means of attaching the various components of the shelf, retaining wall, partition, flaps and the compartment interior could be replaced with other fastening devices, such as adhesives, button snap, plastic adhesive hooks, ties, screws, etc. each having means to attach to the components and the compartment.

The borders of the shelf, the retaining wall and partition could be constructed of other materials, such as plastic, acrylic, rayon, or rope material sufficiently strong enough to secure the shelf and the attachments to the compartment.

Both the built-in flap strips and the separate attachable flaps could be constructed of vinyl, plastic, rubber, or other such material that would provide sufficient strength to secure the shelf to the compartment and be able to harbor fastener devices capable of attaching to both the fastening elements mounted on both the compartment and the shelf.

Thus the scope of the embodiment should be determined by the appended claims and their legal equivalents, rather than by the examples given.

Thus, specific embodiments of an insertable, adjustable and semi-flexible shelf for a cooler have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An insertable, adjustable, semi-flexible shelf and retaining apparatus for installing within a compartment comprising:

(a) a rectangular shelf body configured to be deployed and attached in a horizontal fashion within a compartment covering a predetermined section of the compartment space and mounted below a horizontal opening in the compartment thereby creating a horizontal shelf;

(b) an upright retaining wall formed by raising a portion of said rectangular shelf body, thereby forming a barrier on an open edge of a horizontal edge of a top surface of said rectangular shelf body, and attaching the upright retaining wall to adjacent inside walls of said compartment to keep items from falling off of or out of said horizontal shelf;

(c) a reinforced parametrical border attached on three remaining edges of said shelf incorporating mounted fastening elements for attachment to other fastening elements to be affixed to internal side of said compartment, and (d) at least one adjustable fastener element for mounting said shelf to the inside of said compartment and including respective anchor elements to be affixed by bonding to the inside of said compartment running the length and width on three sides of said compartment interior perimeter for attachment to said reinforced parametrical border of said shelf.

2. The insertable, adjustable, semi-flexible shelf and retaining apparatus of claim 1 wherein said shelf body and border are constructed of reinforced nylon material.

3. The insertable, adjustable, semi-flexible shelf and retaining apparatus of claim 1 wherein said shelf body and border are constructed of at least one of plastic material, PVC and nylon.

4. The insertable, adjustable, semi-flexible shelf and retaining apparatus of claim 1 wherein said at least one adjustable fastener element that are attached to said shelf border are constructed of two-part hook and loop material and are constructed to allow adjustability of said shelf to span within different sized compartment interiors.

5. The insertable, adjustable, semi-flexible shelf and retaining apparatus of claim 1 wherein an upright center partition, acting as a divider, running the length of said shelf horizontally, is attached along its lower edge to the top horizontal center of said shelf horizontally, and attached on one horizontal end to the adjacent inside wall of said compartment, and on the other horizontal end to said retaining wall of said shelf.

6. The insertable, adjustable, semi-flexible shelf and retaining apparatus of claim 5 wherein said partition is constructed of nylon mesh and/or plastic material.

7. The insertable, adjustable, semi-flexible shelf and retaining apparatus of claim 5 wherein said partition is attached to said shelf and to said compartment by hook and loop material.

8. The insertable, adjustable, semi-flexible shelf and retaining apparatus of claim 1 wherein the attachment of said shelf to said compartment is provided by separate attachable flaps of predetermined width and length, incorporating fastening elements along the length of said flaps, and attached between said fastening elements mounted to said shelf border and the respective at least one adjustable fastener elements mounted to said compartment, for attaching said shelf to various sizes of compartments.

9. The insertable, adjustable, semi-flexible shelf and retaining apparatus of claim 8 wherein said flaps are constructed of nylon mesh or plastic material.

10. The insertable, adjustable, semi-flexible shelf and retaining apparatus of claim 8 wherein said fastening elements of said flaps are constructed of hook-and-loop material.

11. The insertable, adjustable, semi-flexible shelf and retaining apparatus of claim 1 that further includes a separate adjustable strap that spans across the compartment under the rectangular shelf body for further support of the shelf.

12. The insertable, adjustable, semi-flexible shelf and retaining apparatus of claim 1 wherein the reinforced parametrical border is reinforced with at least one stay that maintains structural shape of the parametrical border.

13. The insertable, adjustable, semi-flexible shelf and retaining apparatus of claim 12 wherein the stays are made from plastic or metal.

* * * * *